US007431198B2

(12) United States Patent
D'Amato

(10) Patent No.: US 7,431,198 B2
(45) Date of Patent: Oct. 7, 2008

(54) BOX-SHAPED CONTAINER AND BLANK

(75) Inventor: Gianfranco D'Amato, Arzano Naples (IT)

(73) Assignee: Seda S.p.A., Arzano Napoli (IT)

( * ) Notice: Subject to any disclaimer, the term of this patent is extended or adjusted under 35 U.S.C. 154(b) by 3 days.

(21) Appl. No.: 11/487,843

(22) Filed: Jul. 17, 2006

(65) Prior Publication Data

US 2007/0108262 A1 May 17, 2007

(30) Foreign Application Priority Data

Nov. 11, 2005 (DE) ..... 20 2005 017 678 U

(51) Int. Cl.
*B65D 5/00* (2006.01)

(52) U.S. Cl. ..... 229/114; 229/146; 229/906

(58) Field of Classification Search ..... 229/114, 229/146, 904, 148, 149, 150, 902, 906
See application file for complete search history.

(56) References Cited

U.S. PATENT DOCUMENTS 3,343,660 A * 9/1967 Bailey ..... 229/114
4,360,147 A * 11/1982 Brauner ..... 229/146
4,763,832 A * 8/1988 Forbes, Jr. ..... 229/114
4,844,330 A * 7/1989 Roosa et al. ..... 229/902
5,188,284 A * 2/1993 Eisman ..... 229/110
5,205,476 A * 4/1993 Sorenson ..... 229/114
5,520,324 A * 5/1996 Cai ..... 229/148
5,553,772 A * 9/1996 Jensen ..... 229/148
5,788,145 A * 8/1998 Grahahm et al. ..... 229/113
5,826,781 A * 10/1998 Jensen ..... 229/114
6,283,364 B1 * 9/2001 Gray, Sr. ..... 229/149
6,863,212 B2 * 3/2005 Stone et al. ..... 229/128

* cited by examiner

*Primary Examiner*—Gary E Elkins
(74) *Attorney, Agent, or Firm*—Brinks Hofer Gilson & Lione

(57) ABSTRACT

A box-shaped container is formed with two container halves joined together for swiveling along an adjoining edge. Each of the halves comprises a bottom wall, side walls protruding away from same, and rear walls joining them at their ends. The joining edge is formed by the upper end edges of the rear walls. To improve such a box-shaped container in that removal of the food stuff is simplified in a simple constructive manner and without dispensing with the advantages of known containers and at the same time avoiding dirtying the user, the side walls of the first container half are formed with increasing height, and the side walls of the second container half are formed with decreasing height in the respective direction to the front wall.

19 Claims, 2 Drawing Sheets

BOX-SHAPED CONTAINER AND BLANK

RELATED APPLICATIONS

This application is a U.S. patent application claiming priority based on German Application No. 20 2005 017 678.8 filed on Nov. 11, 2005.

BRIEF SUMMARY

The invention relates to a box-shaped container and an appropriate blank. The box-shaped container comprises two halves of the container joined together along a joining edge which can be swivelled about said edge. Each of these first and second container halves comprises a bottom wall, first and second side walls which protrude away from said wall and front and rear walls joining them at their ends. The joining edge is formed by the upper end edge of the rear wall.

This sort of box-shaped container is known in practice for hamburgers or similar products. To remove the hamburger, for example, the first container half is swivelled upwards relative to the second container half, so that the content of the container is accessible for removal. It has become established that with such containers of the prior art each container half also essentially accommodates or covers an upper or lower half of the appropriate foodstuff such as a hamburger or similar product. This means that with the first half of the container open, approximately the lower half of the foodstuff is covered by the lower container half from all sides, making removal difficult in view of the generally restricted free space around the foodstuff. Often, particularly when removing a hamburger, the fingers come into contact with the meat product in the centre or with sauces or similar applied to it. This leads already on the removal of the foodstuff to dirtying the fingers, which is sometimes regarded as unpleasant.

The object of the invention is to therefore improve a box-shaped container of the type mentioned in the introduction such that removal of the foodstuff is simplified in a simple constructive manner and without dispensing with the advantages of the known container and at the same time avoiding dirtying the user.

The object is solved by the features of Claim 1. The invention is particularly characterised in that the side walls of the first container half are formed with increasing height and the side walls of the second container half are formed with decreasing height in each case in the direction of the front wall. Consequently, on one hand complete closure of the box-shaped container is possible to transport the appropriate foodstuff safely and without direct contact. On the other hand, on opening the first container half the removal of the foodstuff is simplified and occurs generally without contact with, in the case of a hamburger, the meat product arranged in the centre and further additives, such as sauces or similar products, from the second container half, because it exhibits, in particular in the region of its front wall, a reduced height of the side walls. In this way the foodstuff can be removed by simply grasping underneath it without contact with the above mentioned products.

There is essentially the possibility of the increase or decrease in height occurring in steps, for example, over one or more steps in height. The manufacture of the container and also the visual appearance can however be improved if the appropriate heights continually increase or decrease.

The manufacture of the container can be further simplified if the slopes of the free end edges of the side walls of both container halves are essentially equal.

In order to otherwise essentially retain the shape of the container with respect to known containers, the rear walls can, for example, be congruent. The height of the container can be determined by these rear walls.

To ensure secure coverage of the foodstuff until opening and removal of the foodstuff, a free end edge of the front wall of the first container half can be convex. With a container placed on an underlay or held in the hand, the first container half is here generally the upper container half, whereas the second container half is the lower one.

Analogously to the free end edge of the front wall, a free end edge of the front wall of the second container half can be concave. This concave curvature further simplifies the removal of the foodstuff from the container.

Since the front wall of the first container half is also formed appropriately with a larger height than the front wall of the second container half—refer to the corresponding height relation for the side walls—with a closed container a relatively large area is formed by the front wall of the first container half, which for example can be advantageously used for printing with appropriate information or for advertising.

The removal of the foodstuff can be further improved if the front wall of the second container half exhibits a lower height than the front ends of the side walls assigned to it. This means that the side walls in the region of the front wall protrude upwards above it and the front wall only forms a slight impairment when removing the foodstuff. Furthermore, the corresponding sections of the side walls protruding over the front wall can be formed as engagement sections which protrude upwards above the front wall in extension of it. These engagement sections can be used to close the container.

In a simple embodiment these engagement sections in extension of the side walls exhibit protruding means of latching or other means of fastening which interact with the side walls or also with the front wall of the first container half when the container is closed.

A simple method of such interaction can be realised when the latching lug engages an open edge notch on the side ends of the front wall of the other container half when the container is closed.

In particular, to simplify closure of the container such that, for example, when swivelling the container halves closed, the corresponding side walls do not come into direct contact with their free ends, the side wall can exhibit a chamfer running downwards in the direction of the bottom wall along its free edge on its end assigned to the rear wall.

This chamfer also avoids possible contact of the free edges of the side walls in this region with adhesive flanges generally arranged in the interior of the container which are arranged between the rear wall and side wall.

The invention also relates to a corresponding two-dimensional blank for the manufacture of such a box-shaped container. This blank exhibits first and second blank halves for the first, respectively second container half and they are joined together along a swivel joint. Each blank half comprises a central bottom section and side, front and rear wall sections protruding sideways from it.

The corresponding blank is characterised according to the invention in that the side wall sections of the first half of the blank increase in height from the rear wall section to the front wall section and the side wall sections of the second half of the blank decrease in height from the rear wall to the front wall section.

To increase the strength of the container, at least one of the front walls of the first or second container half can run between the corresponding side walls with an inward concave curvature. This can be achieved particularly in that a front and bottom wall section of a folding line joining at least the first blank half runs with a concave curvature. Corresponding to this curvature, with the manufactured container also the corresponding front wall runs with a concave curvature between the side walls.

A swivel joint, which is simple to manufacture and can be operated without problems, can in particular be realised in that it exhibits a partially cut and/or perforated joining line between both rear wall sections. The opening and closing of the container is furthermore simplified if in particular the cut part of the joining line runs with a wavy shape.

Analogously to the manufactured container, a free end edge of the front wall section of the first blank half can run with a convex curvature and the second blank half with a concave curvature.

In order to simplify the joint particularly between the rear wall section and the side wall sections, the rear wall section can exhibit folding sections at its side ends for fastening with the side wall sections. Fastening can be realised using adhesive spots or a similar technique or also by melting on a sealing film optionally applied internally on the appropriate sections.

To facilitate a simple arrangement of the above mentioned latching lugs in the region of the front wall of the upper or first container half, the blank can be formed such that the front wall sections of the first blank half exhibit side cut-outs adjacent to its free front end edge, via which lugs protrude to the side essentially in extension of the front end edge. These side cut-outs are then used for receiving the latching lugs and form corresponding latching receptacles.

In order to simplify the arrangement of free end edges of the side walls in this region, the blank can be formed such that the side wall sections of the first blank half exhibit edge receptacles at ends of their free side end edges adjacent to adjoining folding sections, which continue in particular into the folding sections. Due to these edge receptacles, the introduction of the latching lugs on the free front ends of the side walls of the second container half when closing the container is made easier.

In order to avoid a later collision of the free end edges of the side walls with the folding sections on closing the container, the side wall sections of the blank can extend relative to the folding sections further outwards with respect to the corresponding bottom section.

With a closed container the free ends of the side walls, for example of the first container half, cover the corresponding free ends of the side walls of the second container half, so that the closed container in side elevation exhibits no end edges of the side walls normally running horizontally, but rather exhibits free ends of the side walls running in the direction of the front walls diagonally downwards. Consequently, a larger area of the side wall arises which, for example, can be printed with larger motifs or similar designs.

In the following the invention is described in more detail based on an embodiment illustrated in the drawing.

BRIEF DESCRIPTION OF THE DRAWINGS

The following are shown.

DETAILED DESCRIPTION OF THE PREFERRED EMBODIMENTS

Figure 1:
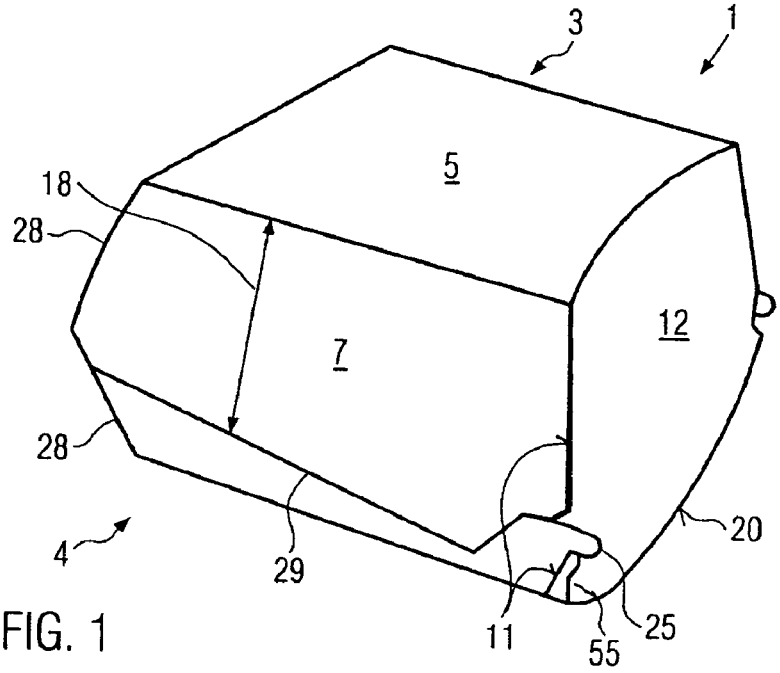
FIG. 1 a box-shaped container according to the invention illustrated in a perspective side elevation.

FIG. 1 shows a perspective side elevation of an embodiment of the box-shaped container 1 according to the invention. It exhibits a first container half 3 and a lower container half 4, which are joined together for swivelling along a joining edge 2, refer also to FIG. 2. In FIG. 1 the two container halves 3 and 4 are folded one over the other so that the container is closed.

Each container half exhibits a bottom wall 5, 6, refer in this respect again to FIG. 2, side walls 7, 8 or 9, 10 protruding away from it and front walls 12, 13 or rear walls 14, 15 which join the side walls at their ends 11 or 28.

In the closed position of the container 1 according to FIG. 1, the side walls 7, 8 of the upper or first container half 3 extend over the corresponding side walls 9, 10 of the second or lower container half 4, so that a free end edge 29 of the upper side walls 7, 8 runs from the corresponding rear wall 14 diagonally downwards in the direction of the front wall 12. This arises due to an increasing height 18 of the corresponding side walls 7, 8 between the rear wall 14 and the front wall 12. The corresponding height 19 of the side walls 9, 10 of the second container half 4 in contrast decreases between the rear wall 15 and the front wall 13.

In FIG. 1 it can be easily seen that a free end edge 20 of the front wall 12 of the first container half 3 runs with a convex curvature and the front wall 12 itself extends between the corresponding side walls 7, 8 with a concave curvature so that it is curved inwards in the direction of the container interior.

Figure 2:
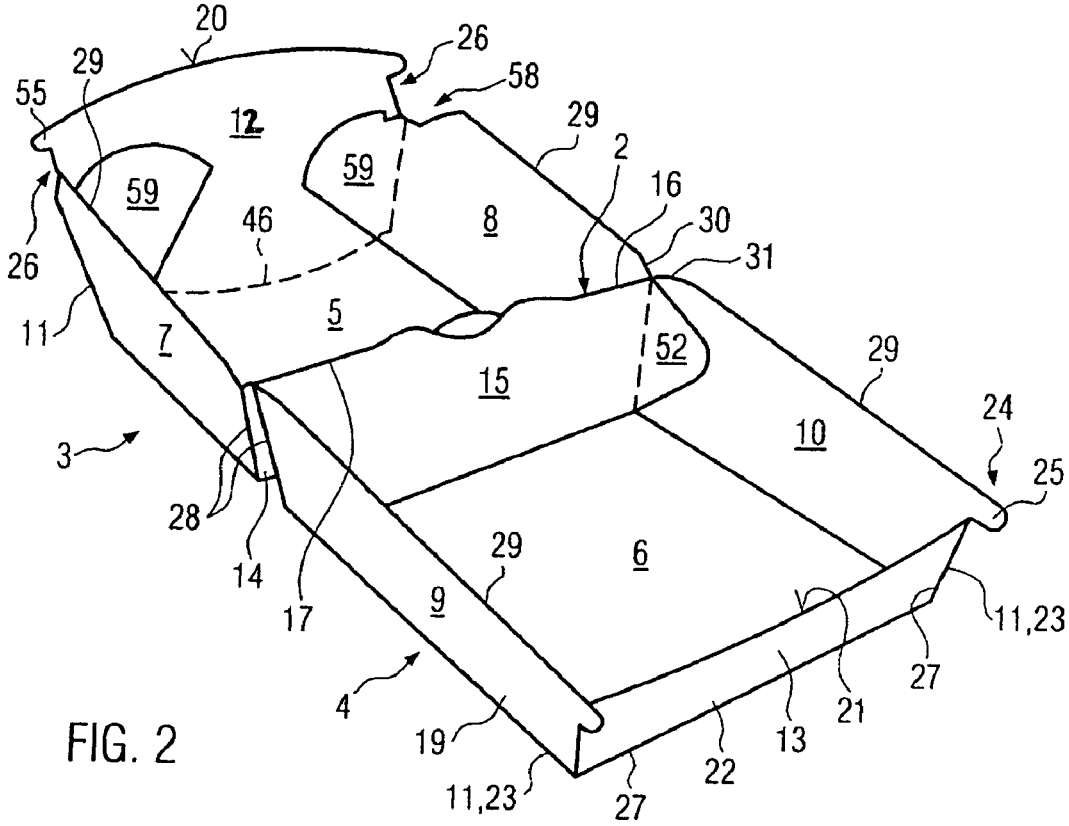
FIG. 2 the container according to FIG. 1 in the open position.

To define the closed state of the box-shaped container 1, the side walls 9, 10 of the second container half 4 exhibit at their front ends 11 engaging sections 24 with protruding latching lugs 25 adjacent to the corresponding front wall 13, refer also to FIG. 2. They engage latching receptacles 26, which are formed in the front wall 12 of the first or upper container half 3, refer to FIG. 1, at the side ends 27.

Figure 3:
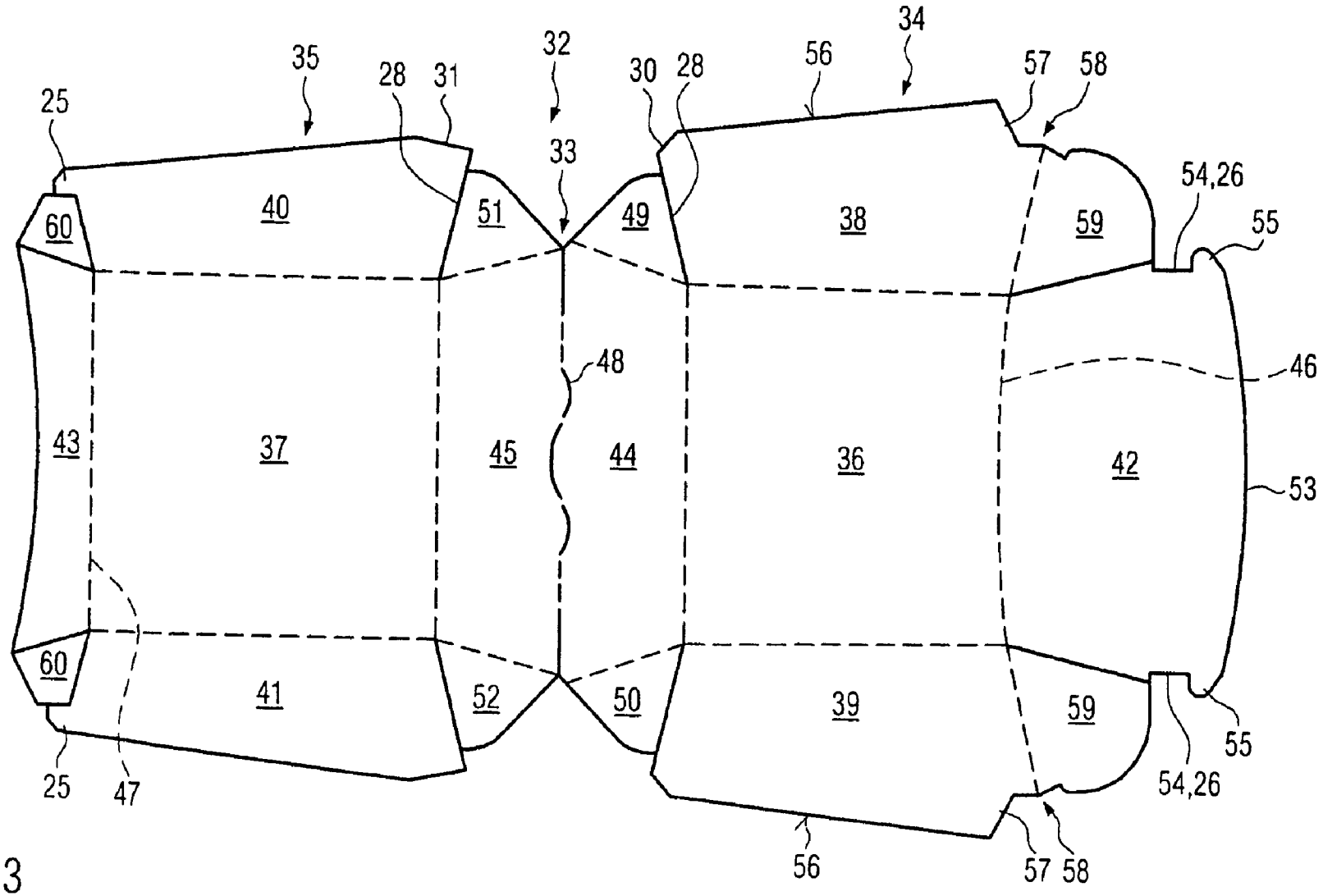
FIG. 3 a plan view of a two-dimensional blank for the manufacture of the container according to FIGS. 1 and 2.

In FIG. 2 a perspective view of a container 1 according to FIG. 1 is illustrated in the open position. The corresponding rear walls 14, 15 are essentially congruent and along the corresponding joining edge 2 of these rear walls, which run along the upper end edges 16, 17, an appropriate swivel joint 33, refer also to FIG. 3, is formed for swivelling the container halves 3, 4 relative to one another. This swivel joint 33 comprises essentially a central section which is formed by a wavy cut line. At the side perforated sections can adjoin this wavy cut line. They can extend up to the side ends of the swivel joint 33 or change into corresponding folding lines.

In the interior of the first container half 3, it can be seen in FIG. 2 that appropriate folding sections 59 are fitted to the inner side of the front wall 12. These are joined to the side walls 7, 8 via folding lines.

The front wall 12 of the first container half 3 extends in FIG. 2 upwards to its convex free end edge 20. Appropriate lugs 55, refer also to FIG. 3, are formed on their side ends. Below these lugs 55 the latching receptacles 26 are formed as receptacles open at the side. In these latching receptacles 26 essentially an edge receptacle 58 opens out which is formed on the ends of the side walls 7, 8 pointing to the front wall 12 and which essentially is used for accommodating the engaging sections 24 of the other side walls 9, 10 when the container is closed, refer to FIG. 1.

At their rear ends 28 pointing to the corresponding rear walls 14, 15, the side walls 7, 8 and 9, 10 exhibit chamfers 30, 31 along the free edges 29. They extend downwards in the direction of the upper end edges 16, 17 of the rear walls 14, 15.

The rear walls 14, 15 are essentially congruent and only differ in the wavy pattern along the corresponding cut line along the joining edge 2. Whereas the rear wall 14 exhibits a pattern of two wave troughs and a wave crest, the corresponding rear wall 15 exhibits a pattern of two wave crests and a wave trough arranged between them.

The front wall 13 of the second container half 4 is formed with a height 22 which is less than a corresponding height 19 of the corresponding side walls 9 and 10 in the region of the front ends 23 which are formed as ends 11 of the side walls. At these front ends 23 the side walls protrude beyond the front wall 13 essentially with their engaging section 24, which, in particular at the front, exhibits latching lugs 25 protruding above the front wall.

At least the front wall 12 of the first container half 3, refer also to FIG. 1, runs with concave curvature with respect to the container interior and is joined to the corresponding bottom wall 5, refer to FIG. 2, via a folding line 46 running with concave curvature. There is also the possibility that a folding line joining the front wall 13 and bottom wall 6, refer to reference symbol 47 in FIG. 3, runs with a concave curvature so that in this case both front walls exhibit a corresponding concave curvature with respect to the container interior.

In FIG. 2 in the region of the rear wall 15 of the second container half 4 the folding sections 52 or 51 can still be seen, refer to FIG. 3, which are joined to the rear wall 15 via a folding line and are fastened from inside on the side walls 9, 10 by, in particular, adhesive.

The free end edges 20, 21 of the front walls 12, 13 also run curved, whereby the free end edge 20 of the front wall 12 runs convex and the free end edge 21 of the front wall 13 runs with a concave curvature.

In FIG. 3 a plan view on a two-dimensional blank 32 is illustrated from which the box-shaped container 1 can be built up according to FIGS. 1 and 2. The blank 32 comprises a first blank half 34 and a second blank half 35. From the first blank half 34 the first container half 3 is formed and the second container half 4 is formed from the second blank half 35.

Each of the blank halves exhibits a central bottom section 36, 37, side wall sections 38, 39 and 40, 41 protruding away from it and front wall sections 42, 43 and rear wall sections 44, 45 joining them at their ends. Both rear wall sections 44, 45 are joined together by means of the joining line 48 as swivelling line 33. Part of the joining line 48 is formed by a wavy cut line at the ends of which perforation sections follow which then change into folding lines.

Appropriate folding sections 49, 50 and 51, 52 are arranged on the side ends of the corresponding rear wall sections 44, 45 and they are joined to the rear wall sections by means of folding lines.

Further folding lines, refer to the illustrations in FIG. 3 shown in dashed lines, are formed between the various side wall sections and the respective bottom section as well as between the front wall sections and the bottom section. In particular the folding line 46 between the front wall section 42 and the bottom wall section 36 of the first blank half 34 is formed curved, whereby it exhibits a concave curvature. This curvature ensures the corresponding concave run of the front wall 12 in FIG. 1.

The corresponding folding line 47 between the front wall section 43 and the bottom section 37 of the second blank half 35 can also run with a concave curvature or also in a straight line.

The front wall section 42 exhibits a free front end edge 53 which forms the free end edge 20 with a correspondingly convex curvature in the finished container 1 according to FIG. 1. Analogously, a corresponding free front end edge of the front wall section 43 can form the concave free end edge 21 of the container, refer to FIG. 2.

The side wall sections 40, 41 are separated by means of cut lines from the folding sections 60 on the side ends of the front wall section 43, whereby the corresponding engaging section 24 is formed along these cut lines with latching lugs 25, refer also to FIG. 2.

On the respective ends 28 of the corresponding side wall sections 38, 39, 40, 41, pointing to the rear wall sections 44, 45, they exhibit, in extension of their side end edges 56 or along their free edges 29, refer to FIG. 2, chamfers 30, 31 running diagonally downwards in the direction of the corresponding folding sections.

Opposite the chamfer 30 the side wall sections 38 and 39 exhibit in addition edge receptacles 58 on the ends 57, which run up into the corresponding folding sections 59 between the side wall sections 38, 39 and the front wall section 42. With the finished container 1, refer to FIG. 2, these edge receptacles 58 form corresponding latching receptacles 26 for the accommodation of the latching lugs 25 as well as also for the partial accommodation, refer to FIG. 1, of the upper ends of the side wall sections 40, 41 of the second blank half 35.

In FIG. 3, directly following the corresponding folding sections 59, cut-outs 54, open at the side, are arranged which accordingly form the latching receptacles 26 in the front wall section and interact with the edge receptacles 58 on the finished container, refer again to FIG. 2.

The container according to the invention is characterised by improved grasping for the user, which is facilitated by the lower height of the side walls 9, 10 and front wall 13 in the region of the second container half 4, refer to FIG. 2. This simplified removal is further supported by the appropriate curvature of the free end edges 21 of the front wall 13. At the same time, relatively large areas for the side walls 7, 8 and in particular also for the front wall 12 are produced for the first container half 3, refer to FIG. 1. The corresponding concave curvature of at least the front wall 12 and optionally also of the front wall 13 inwards towards the container interior increases the strength of the container.

The invention claimed is:

1. Box-shaped container (1) from two container halves (3, 4), joined together for swiveling along a joining edge (2), each of which comprises a bottom wall (5, 6), side walls (7, 8; 9, 10) protruding away from them and front and rear walls (12, 13, 14, 15) joining them at their ends (11, 28), wherein the joining edge (2) is formed by the upper end edges (16, 17) of the rear walls (14, 15), characterised in that the side walls (7, 8) of the first container half (3) are formed with increasing height (18, 19) and the side walls (9, 10) of the second container half (4) are formed with decreasing height (18, 19) in the respective direction to the front wall (12, 13), and the front wall (12, 13) of the first and/or second container half (3, 4) has an inward concave curvature between the side walls (7, 8; 9, 10).

2. Box-shaped container according to claim 1, characterised in that the height (18, 19) increases, respectively decreases continuously.

3. Box-shaped container according to one of the claims 1 or 2,
characterised in that
the side walls (7, 8; 9, 10) have free edges (16, 17), and the free edges (16, 17) of the side walls (7, 8; 9, 10) of both container halves (3, 4) have slopes which are essentially equal.

4. Box-shaped container according to one of the claims 1 or 2,
characterised in that
the rear walls (14, 15) are essentially congruent.

5. Box-shaped container according to one of the claims 1 or 2
characterised in that
one free end edge (20) of the front wall (12) of the first container half (3) has a convex curvature.

6. Box-shaped container according to one of the claims 1 or 2,
characterised in that
one free end edge (21) of the front wall (13) of the second container half (14) has a concave curvature.

7. Box-shaped container according to claim 1,
characterised in that
the front wall (13) of the second container half (4) exhibits a lower height (22) than the front ends (23) of side walls (9, 10) in the second container half and the side walls (9, 10) in the second container half protrude from those side walls in an engaging section (24) extension of the front wall (13) upwards in the side walls (9, 10) in the second container half.

8. Box-shaped container according to claim 7,
characterised in that
the engaging section (24) exhibits a protruding latching lug (25) in extension of the side walls (9, 10) in the second container half.

9. Box-shaped container according to claim 8,
characterised in that
with the container halves closed (3, 4) the latching lug (25) engages in a side open latching receptacle (26) on the side end (27) of the front wall (12) of the other container half (3).

10. Box-shaped container according to claims 1 or 2,
characterised in that
the side wall (7, 8; 9, 10) exhibits a chamfer (30, 31) running downwards to the rear wall (14, 15) along the free edge (29) of the corresponding side wall in the direction of the bottom wall (5, 6) on its end (28) adjacent to the rear wall.

11. Blank (32) for a box-shaped container (1) according to claim 1 with first and second blank halves (34, 35), joined together along a swivel joint (33), for respectively the first and second container halves (3, 4), wherein each blank half (34, 35) comprises a central bottom section (36, 37) and side wall sections (38, 39; 40, 41) protruding away from it as well as front and rear wall sections (42, 43, 44, 45),
characterised in that
the side wall sections (38, 39) of the first blank half (34) increase in their height from the rear wall section to the front wall section (44, 42) and the side wall sections (40, 41) of the second blank half (35) decrease in their height (19) from the rear wall section to the front wall section (45, 43).

12. Blank according to claim 11,
characterised in that
the height (18, 19) increases, respectively decreases uniformly.

13. Blank according to one of the claims 11 or 12,
characterised in that
a folding line (46, 47) joining a front wall section (42) and a bottom wall section (36) at least of the first blank half (34) runs with a concave curvature.

14. Blank according to one of the claims 11 to 12,
characterised in that
the swivel joint (33) exhibits a partially cut and/or perforated joining line (48) between the two rear wall sections (44, 45).

15. Blank according to one of the claims 11 to 12,
characterised in that
a free end edge (20, 21) of the front wall section (42) of the first blank half (34) runs with a convex curvature and of the second blank half (35) with a concave curvature.

16. Blank according to one of the claims 11 to 12,
characterised in that
the rear wall section (44, 45) exhibits folding sections (49, 50, 51, 52) on its side ends for fastening with the side wall sections (38, 39; 40, 41).

17. Blank according to one of the claims 11 to 12,
characterised in that
the front wall section (42) of the first blank half (34) adjacent to the free front end edge (53) exhibits side cut-outs over which lugs (55) protrude sideways essentially in extension of the front end edge (53).

18. Blank according to one of the claims 11 to 12,
characterised in that
the side wall sections (38, 39) of the first blank half (34) on the ends (57) of their free side end edges (56) exhibit edge receptacles, adjacent to the following folding sections, which in particular continue into the folding sections.

19. Blank according to one of the claims 11 to 12,
characterised in that
the side wall sections (38, 39, 40, 41) extend further outwards with respect to the bottom section (36, 37) relative to the folding sections (49, 50, 51, 52).

* * * * *